US005577408A

United States Patent [19]

Roos

[11] Patent Number: 5,577,408

[45] Date of Patent: Nov. 26, 1996

[54] SECURITY DEVICE FOR A CYLINDER LOCK

[76] Inventor: Åge Roos, Nordre Elvegate 10, N-1537 Moss, Norway

[21] Appl. No.: 337,725

[22] Filed: Nov. 10, 1994

[30] Foreign Application Priority Data

Dec. 29, 1993 [NO] Norway ..... 934885

[51] Int. Cl.[6] ..... E05B 9/04

[52] U.S. Cl. ..... 70/370; 70/371; 70/451; 70/466; 70/DIG. 57

[58] Field of Search ..... 70/DIG. 57, 367–371, 70/451, 224, 466

[56] References Cited

U.S. PATENT DOCUMENTS

| | | | |
|---|---|---|---|
| 1,253,470 | 1/1918 | Cox | 70/DIG. 57 X |
| 1,268,137 | 6/1918 | Mailloux | 70/DIG. 57 X |
| 1,337,137 | 4/1920 | Kaplan | 70/DIG. 57 X |
| 1,512,939 | 10/1924 | Ledin | 70/DIG. 57 X |
| 1,546,626 | 7/1925 | Crouch . | |
| 1,986,453 | 1/1935 | Shaw | 70/369 |
| 3,368,374 | 2/1968 | Eads | 70/370 |
| 3,760,619 | 9/1973 | Colombo | 70/DIG. 57 X |
| 3,763,673 | 10/1973 | Colombo et al. | 70/370 X |
| 3,855,826 | 12/1974 | Hori | 70/DIG. 57 X |
| 3,981,168 | 9/1976 | Vanelli Coralli et al. | 70/370 X |
| 4,202,587 | 5/1980 | Wieland | 70/370 X |
| 4,223,542 | 9/1980 | Basseches | 70/DIG. 57 X |
| 4,567,741 | 2/1986 | Trempala | 70/DIG. 57 X |
| 5,377,511 | 1/1995 | Meckbach | 70/371 X |

FOREIGN PATENT DOCUMENTS

| | | | |
|---|---|---|---|
| 481301 | 5/1976 | Australia | 70/451 |
| 63012 | 12/1944 | Denmark | 70/367 |
| 361011 | 10/1922 | Germany | 70/DIG. 57 |
| 502998 | 7/1930 | Germany | 70/370 |

*Primary Examiner*—Lloyd A. Gall

[57] ABSTRACT

An arm is affixed to the inner face of the lock cylinder and prevents the lock cylinder from being removed from the lock case. A screw attaches the arm to the lock cylinder. The lock cylinder has a cam which is also attached to the inner face of the lock cylinder and rotates to operate the lock case mechanisms. The cam, when it is rotated into a lock position, covers the head of the screw and prevents the screw from being removed. Since the cam prevents removal of the screw, the arm cannot be removed from the lock cylinder and the lock cylinder cannot be removed from the lock case.

17 Claims, 1 Drawing Sheet

SECURITY DEVICE FOR A CYLINDER LOCK

Figure 1:
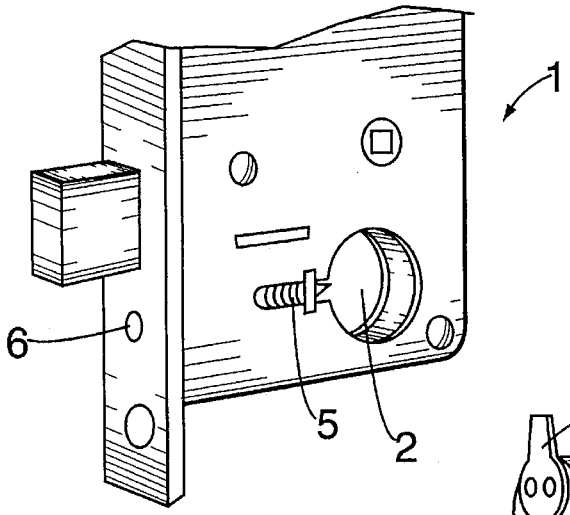

The present invention relates to a lock cylinder provided with means for attachment in a lock case, said lock cylinder comprising a cylinder plug which is rotatable in a lock body by means of a key and assumes a locked position in the cylinder body when the key is removed, the inner end of the cylinder plug being provided with a cam which through the use of the key can be brought to operate mechanisms in the lock and which in said locking position covers a portion of the inner end face of the cylinder body.

Such lock cylinders are normally fixed to the lock case by means of a screw which is accessible only through a hole in the front of the lock case. The door mounting the lock case must therefore be opened before the screw may be loosened and the lock cylinder removed from the lock.

In hotels, passenger ships and similar places where it is important to be able to change the lock code in a simple and inexpensive manner, so-called card locks are used, i.e. locks where the key is a card having a code of holes or a magnetic code. For reasons of safety, in many cases it is necessary to have an extra lock in addition to the card lock, said extra lock normally being a cylinder lock that may be used for emergency opening in case of battery failure, fire or other emergency situations. These extra locks can normally be opened by one and the same master key.

Lately, a special burglary method has been used for locks of the above mentioned type. The method entails that the "burglar" rents a room for a shorter period in order to gain legitimate access to the room. While there he removes the lock cylinder and possibly replaces it with a similar cylinder in order to camouflage the theft.

Next, the stolen cylinder is used to detect the key combination of the master key. A skilled locksmith can determine the shape of the master key by studying the key cuts, the driver and tumbler pins and the profiles. By having such a key made, the burglar can open all locks in the building.

The object of the present invention is to make it as difficult as possible for unauthorized persons to remove the lock cylinder while not making it impossible for authorized personnel to do the same.

This is obtained according to the invention through a lock cylinder of the type mentioned by way of introduction, where the characteristic features are that said means comprises a securing element which is attachable to said portion of the inner end face of the cylinder body by means of a device which is blocked by the cam on the cylinder plug in its locking position.

With such a configuration of the lock cylinder it will no longer be sufficient to be able to open the door to get access to the attachment screw through the lock front in order to remove the cylinder. In addition, one will need access to the key of the lock cylinder in order to pivot the cam to such a position that it no longer blocks the attachment device for the securing element according to the invention.

Further advantageous features of the invention are recited in the dependent claims.

Figure 2:
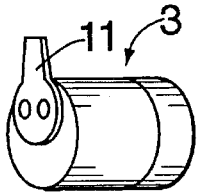
Figure 3:
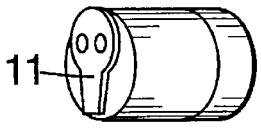
Figure 4:
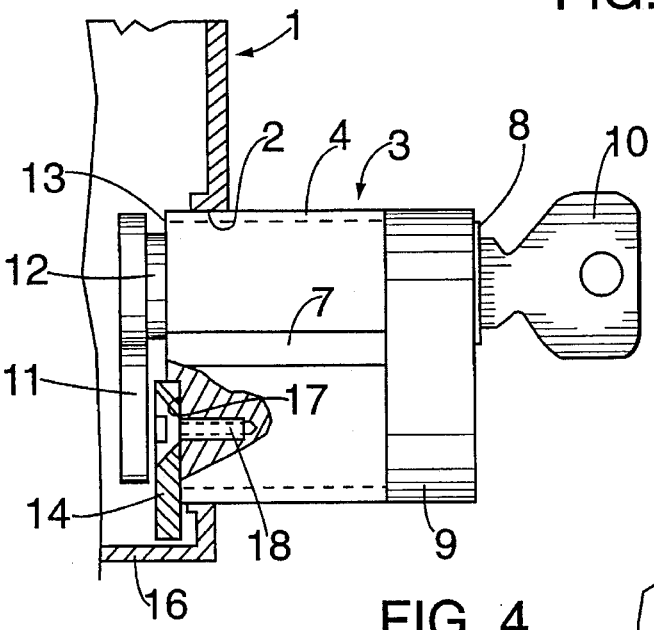
Figure 5:
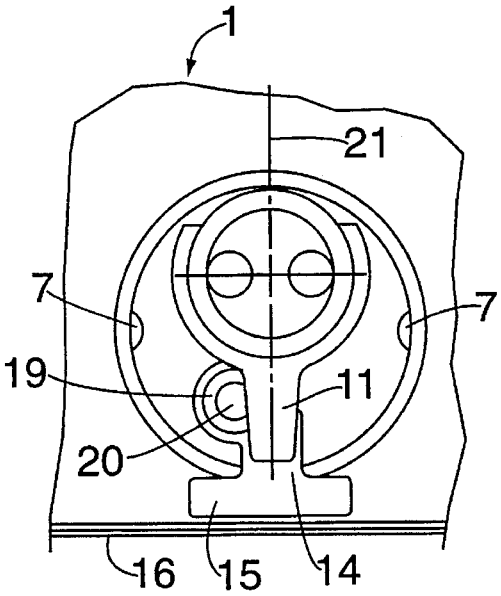

For better understanding of the invention it will be described more closely with reference to the accompanying drawings, where:

FIG. 1 shows isometrically and schematically a portion of a lock case having a hole for the installation of a lock cylinder according to the invention;

FIGS. 2 and 3 schematically and isometrically show a conventional lock cylinder with the cam rotatable by means of the key shown in active and locked position;

FIG. 4 schematically shows a sectioned portion of the lock case in FIG. 1 with a lock cylinder according to the invention, partly in section, installed; and FIG. 5 shows the arrangement in FIG. 4 seen from left to right.

The lock case 1 shown in FIG. 1 is provided with a threaded hole 2 into which a lock cylinder 3 having external threads 4 (see FIG. 4) may be screwed following the fixation of the lock case 1 in its cavity in the door. Usually, the lock cylinder is secured against removal from the lock case by means of a set screw 5, which is operated through a hole 6 in the front of the lock case. The set screw 5 engages into a longitudinal groove 7 (FIGS. 4 and 5) in the circumferential surface of the lock cylinder.

The lock cylinder 3 comprises a cylinder plug 8 which is rotatable in the cylinder body 9 by means of a key 10. A cam 11 is fixedly connected to the inner end 12 of the cylinder plug 8 so that the cam 11 may be rotated by means of a key 10 from the position shown in FIGS. 3–5 to e.g. the position shown in FIG. 2, where the cam can operate a mechanism in the lock case. In the position of the cam shown in FIGS. 3–5 the key 10 can be removed from the cylinder plug 8 in order to lock the cylinder plug and cam 11 in this position.

A securing arm 14 preventing the lock cylinder 3 from being screwed out of the hole 2 in the lock case, is attached to the inner end face 13 of the cylinder body 9. In the embodiment shown, such unscrewing is prevented by a foot 15 located in close proximity to the bottom 16 of the lock case.

The securing arm 14 is partly recessed into a cavity 17 in the inner end face 13 of the cylinder body in order to withstand relatively high lateral loads without twisting with respect to the lock cylinder. The arm 14 is attached by means of a screw 18 having a recessed head 19 with a slot 20 for an Allen wrench. The screw 18 is placed to the side of the plane 21 extending through the central axes of the cylinder plug and cylinder body in order not to interfere with the bores for the tumbler pins of the lock cylinder. As apparent from FIG. 5, the head 19 of the screw and wrench slot 20 are still located so that they are blocked by the cam 11 in the locked position of the latter. Thus, it will not be possible to remove the securing arm 14 without first rotating the cam 11 away from the blocking position, which can only be done by means of the key of the lock cylinder.

It will be understood that the securing arm 14 is attached to the lock cylinder 3 after the lock cylinder having been screwed in place in the lock case 1 and the cam 11 rotated away from its blocking position. The installation of the arm 14 may preferably be done from the inside of the door before the escutcheons are installed.

It will be understood that the securing arm can have other forms than the one illustrated. Instead of the foot 15, the securing arm may be provided with a free end depending into a hole arranged in the bottom 16 of the lock case. The arm may also be secured by more than one screw, e.g. one on either side of the central axis plane 21.

I claim:

1. A lock cylinder comprising:

(a) a cylinder body which attaches to a lock case by means of external threads which correspond to threads in a hole in said lock case, said cylinder body having an inner face;

(b) a cylinder plug which fits inside and is rotatable inside said cylinder body by means of a key, said cylinder plug having an inner face;

(c) a securing element attached by means of a screw to said inner face of said cylinder body; and (d) a cam for operating mechanisms in said lock case, said cam attached to said inner face of said cylinder plug, said cam rotatable by means of said cylinder plug and said key between a locked and an unlocked position, said cam covering said screw when said cam is in said locked position to prevent removal of said screw.

2. The lock cylinder of claim 1 wherein said securing element has a foot which is located near a wall of the lock case when said lock cylinder is in said lock case.

3. The lock cylinder of claim 2 wherein said screw is positioned to one side of a plane that runs through the central axis of said cylinder body.

4. The lock cylinder of claim 1 wherein said screw is positioned to one side of a plane that runs through the center axis of said cylinder body.

5. The lock cylinder of claim 1 wherein said inner face of said cylinder body has a cavity therein and said securing element is attached to said inner face of said cylinder body in said cavity.

6. The lock cylinder of claim 5 wherein said screw is positioned to one side of a plane that runs through the central axis of the cylinder body.

7. A lock cylinder having a means for attaching to a lock case, said lock cylinder comprising a cylinder plug which is rotatable in a cylinder body by means of a key, said cylinder plug being in a locked position in said cylinder body when said key is removed from said cylinder plug, said cylinder plug having an inner end and a cam attached to said inner end, said key causing said cam to operate mechanisms in said lock case, said cam covering a portion of an inner end face of said cylinder body when said cylinder plug is in said locked position, characterized in that the means for attaching said lock cylinder to said lock case comprises a securing element attached by means of a device to said inner end face of said cylinder body such that said cam blocks access to said device when said cylinder plug is in said locked position, said securing element being installed in a cavity in said end face of said cylinder body.

8. A lock cylinder according to claim 7, where the cylinder body is circularly cylindrical and provided with external threads for attachment in a threaded hole in the lock case, characterized in that the securing element comprises an arm which prevents rotation of the cylinder body.

9. A lock cylinder according to claim 8, characterized in that the arm is provided with a foot which is located near the bottom of the lock case when said arm is attached to said cylinder body.

10. A lock cylinder according to claim 9, characterized in that said device for attachment of the arm to said cylinder body is a screw which is placed to one side of a plane through the central axes of the cylinder plug and said cylinder body.

11. A lock cylinder according to claim 10, characterized in that the screw has a recessed head with a slot for an Allen wrench.

12. A lock cylinder having a cylinder body which is circularly cylindrical and provided with external threads for attachment in a threaded hole of a lock case and having a cylinder plug which is rotatable in said cylinder body by means of a key, said cylinder plug being in a locked position in said cylinder body when said key is removed from said cylinder plug, said cylinder plug having an inner end and a cam attached to said inner end, said key causing said cam to operate mechanisms in said lock case, said cam covering a portion of an inner end face of said cylinder body when said cylinder plug is in said locked position, characterized in that an arm is attached to said inner end face of said cylinder body by means of a device such that said cam blocks access to said device when said cylinder plug is in said locked position, said arm preventing rotation of the cylinder body.

13. A lock cylinder according to claim 12, characterized in that the arm is provided with a foot which is located near the bottom of the lock case when said arm is attached to said cylinder body.

14. A lock cylinder according to claim 13, characterized in that said device for attachment of the arm to said cylinder body is a screw which is placed to one side of a plane through the central axes of the cylinder plug and said cylinder body.

15. A lock cylinder according to claim 14, characterized in that the screw has a recessed head with a slot for an Allen wrench.

16. A lock cylinder according to claim 12, characterized in that said device for attachment of the arm to said cylinder body is a screw which is placed to one side of a plane through the central axes of the cylinder plug and said cylinder body.

17. A lock cylinder according to claim 16, characterized in that the screw has a recessed head with a slot for an Allen wrench.

* * * * *